US012246810B2

(12) United States Patent
Nydahl

(10) Patent No.: US 12,246,810 B2
(45) Date of Patent: Mar. 11, 2025

(54) METHOD FOR CONTROLLING MARINE HYBRID SYSTEMS

(71) Applicant: CPAC SYSTEMS AB, Gothenburg (SE)

(72) Inventor: David Nydahl, Partille (SE)

(73) Assignee: CPAC SYSTEMS AB, Gothenburg (SE)

( * ) Notice: Subject to any disclaimer, the term of this patent is extended or adjusted under 35 U.S.C. 154(b) by 623 days.

(21) Appl. No.: 17/439,624

(22) PCT Filed: Mar. 20, 2019

(86) PCT No.: PCT/EP2019/056988
§ 371 (c)(1),
(2) Date: Sep. 15, 2021

(87) PCT Pub. No.: WO2020/187416
PCT Pub. Date: Sep. 24, 2020

(65) Prior Publication Data

US 2022/0177102 A1 Jun. 9, 2022

(51) Int. Cl.
*B63H 21/21* (2006.01)
*B63H 21/20* (2006.01)
*B63H 23/34* (2006.01)

(52) U.S. Cl.
CPC ..... *B63H 21/21* (2013.01); *B63H 21/20* (2013.01); *B63H 23/34* (2013.01); *B63H 2021/205* (2013.01); *B63H 2021/216* (2013.01)

(58) Field of Classification Search
CPC ..... B63H 21/21; B63H 21/20; B63H 23/34; B63H 2021/205; B63H 2021/216; B63H 23/30
See application file for complete search history.

(56) References Cited

U.S. PATENT DOCUMENTS 8,725,329 B1 5/2014 Snyder et al.
2010/0274420 A1* 10/2010 Veit ..... B63H 3/10 440/75

(Continued)

OTHER PUBLICATIONS

International Search Report and Written Opinion dated Nov. 4, 2019 in corresponding International PCT Application No. PCT/EP2019/056988, 10 pages.

*Primary Examiner* — Tyler J Lee
*Assistant Examiner* — Kimia Kohankhaki
(74) *Attorney, Agent, or Firm* — Venable LLP; Jeffri A. Kaminski

(57) ABSTRACT

A method to control at least a first and a second parallel hybrid driveline arranged to drive a marine vessel is provided. Each driveline comprises a first propulsion unit operatively connected with a second propulsion unit to drive a propeller shaft and produce a thrust force. At least one control unit controls each first and second propulsion unit in all the parallel hybrid drivelines.
The method involves individual adjustment of the rotational speed of the first propulsion unit in each driveline to improve the efficiency of this first propulsion unit while maintaining the requested vessel speed, and a simultaneous adjustment of the load from the second propulsion unit in each driveline to improve the efficiency of each driveline and the complete driveline installation.

12 Claims, 7 Drawing Sheets

(56) References Cited

U.S. PATENT DOCUMENTS

| | | | | |
|---|---|---|---|---|
| 2011/0028057 | A1* | 2/2011 | Torrangs | B63H 25/02 440/53 |
| 2012/0083173 | A1* | 4/2012 | McMillan | B63H 21/20 903/930 |
| 2014/0324256 | A1 | 10/2014 | Aschaber | |
| 2014/0352595 | A1* | 12/2014 | Yuet | B63H 25/42 114/150 |

* cited by examiner

METHOD FOR CONTROLLING MARINE HYBRID SYSTEMS

CROSS-REFERENCE TO RELATED APPLICATIONS

This application is a U.S. National Stage application of PCT/EP2019/056988, filed Mar. 20, 2019, and published on Sep. 24, 2020, as WO 2020/187416 A1, all of which is hereby incorporated by reference in its entirety.

TECHNICAL FIELD

The invention relates to control of marine hybrid installations with multiple drivelines, comprising internal combustion engines and electric motors, which drivelines are used to operate marine vessels, such as leisure craft boats.

BACKGROUND

Most marine hybrid systems use a control strategy based on power demand, which demand is controlled by an operator. For marine vessels comprising multiple drivelines the power demand is distributed equally between all drivelines and the internal combustion engines and electric motors in each driveline are operated individually or together, depending on factors such as the magnitude of the power demand and/or the charge level, or state of charge (SOC), of the electrical storage units.

Marine hybrid systems having a control strategy based on power demand and automatic hybrid functionality may attempt to control the internal combustion engines to operate at or near optimum efficiency. However, the power demand, and thus the rotational speed of the propulsion units, is controlled by the operator. Consequently, optimum efficiency operation of the internal combustion engines is often not possible and may be achieved at the expense of inefficient operation of the electrical motors.

The invention provides an improved method for controlling marine hybrid systems and aims to solve the above-mentioned problems.

SUMMARY

An object of the invention is to provide a method for controlling marine hybrid systems and a marine hybrid system, which solves the above-mentioned problems.

The object is achieved by a method according to claim 1.

In the subsequent text, the term "driveline" is used to describe an installation comprising a combination of propulsion units. Such a driveline is preferably a parallel hybrid driveline. Examples of propulsion units are internal combustion engines (ICE) and electric motors (EM). Each driveline is arranged to drive a propeller shaft provided with one or more propellers. The electric motors can be powered by a common electrical storage unit or by individual electrical storage units for each electric motor. The electrical storage units can also be referred to as batteries. The internal combustion engines are operated at a requested or determined engine speed. In the subsequent text, the term engine speed can also be referred to as the rotational speed of the first propulsion unit. A suitable reduction gearing, or another suitable transmission is provided to reduce the engine speed to a lower rotational output to a propeller shaft. The location of the reduction gearing can be dependent on the type of electric motor used. The reduction gearing can for instance be arranged adjacent the output shaft of the electric motor, if the propulsion units are operated at the same rotational speed. Alternatively, the reduction gearing can be arranged adjacent the output shaft of the internal combustion engine, wherein the electric motor is rotated at the rotational output speed of a propeller shaft. These terms will be adhered to in the subsequent text.

According to one aspect of the invention, the object is achieved by means of a method to control at least a first and a second parallel hybrid driveline arranged to drive a marine vessel. Each driveline comprises a first propulsion unit in the form of an internal combustion engine operatively connected with a second propulsion unit in the form of an electric motor to drive a propeller shaft and produce a thrust force for propelling the vessel. An alternative arrangement can be to use a driveline comprising two first propulsion units and two second propulsion units operatively connected to a single propeller shaft. In the subsequent text, the term "first propulsion unit" is used to indicate an internal combustion engine (ICE) and the term "second propulsion unit" is used to indicate an electric motor (EM). The internal combustion engine is operatively connected to the electric motor via a driveshaft, which driveshaft can comprise an optional controllable clutch. At least one control unit is arranged for individual control of each first and second propulsion unit in all the parallel hybrid drivelines. All parallel hybrid drivelines can be controlled by a central driveline control unit controlling each internal combustion engine and electric motor in the respective drivelines. Alternatively, individual control units can be provided for each internal combustion engine and each electric motor in the respective parallel hybrid driveline. According to a further alternative, a central driveline control unit can be used in combination with individual control units for each propulsion unit. Transmission and exchange of data between control units can be made using a Controller Area Network (CAN bus), Local Area Network (LAN) or a similar wired connection, or by using a suitable Wireless Local Area Network (WLAN) or other wireless technology such as WiFi or Bluetooth.

The method involves performing the steps of:

- receiving a request indicative of a vessel speed;
- determining a rotational speed for each first propulsion unit for achieving the requested vessel speed, based on the received request;
- determining efficiency points for each of the first and the second propulsion units from efficiency maps for each propulsion unit, based on the determined rotational speeds;
- individually adjusting the rotational speed of the first propulsion unit in each driveline to improve the efficiency of this first propulsion unit while maintaining the requested vessel speed, and
- simultaneously adjusting the load from the corresponding second propulsion unit in each driveline to improve the efficiency of each driveline and the complete driveline installation;

wherein the individual drivelines are controlled so that the combined rotational speed from all first propulsion units is sufficient for maintaining the requested vessel speed.

A request indicative of a vessel speed can be received from a controller operated by a user, which controller can be a joystick or multiple levers. In operation, the operator requests a vessel speed by actuating the controller to a lever setting between zero and full throttle. The displacement of the lever between these end points will not correspond to a linear increase in actual vessel speed. However, the engine speed will be a linear function the lever displacement, so the displacement of a lever to a particular setting is actually a request for an engine speed corresponding to this setting. Consequently, the user makes a request indicative of a vessel speed and the control unit receives a request for an engine speed.

A controller can be a single joystick controlling all drivelines. The controller can also comprise one or multiple levers for controlling one or more drivelines. For instance, installations comprising two drivelines can have two levers, which can be displaced individually or together. A triple installation can have three levers, wherein a center lever can output a signal representing an average value for an engine speed request. A quad installation can instead use two levers controlling two drivelines each. When requesting a vessel speed, the levers are usually displaced together. An exception to this is of course low speed maneuvering, e.g. a docking maneuver, where individual displacement can be required to achieve a vessel displacement is a desired direction. Allowing each lever to control more than one driveline is preferable for installations having more than four drivelines.

As indicated above, the rotational speed for each first propulsion unit is controlled for achieving the requested vessel speed, based on the received request from the operator. However, if the requested vessel speed is below a predetermined limit for the current rotational speed, then the desired speed can instead be achieved by clutch control. For instance, relatively low maneuvering speeds for docking can be achieved by allowing the clutch to slip while the first propulsion unit is operated at or just above its idling speed.

Internal combustion engines and electric motors both have optimum efficiency points in respect to the conversion of energy to mechanical movement. The object of the invention is to balance the combined efficiency mapping between the drivelines to achieve the best possible combined efficiency for all drivelines. The efficiency points for each ICE and EM is determined from efficiency maps stored in the central control unit or in each individual control unit. Examples of efficiency maps will be described in further detail below.

When using a central control unit or multiple control units, data required for controlling the propulsion units will need to be exchanged between a central control unit and the drivelines or between individual control units for each driveline, so that all propulsion units can be operated together. Coordinated control of the propulsion units is primarily performed for maintaining the requested speed. The requirement of maintaining the requested speed will necessitate an exchange of data between control units when the rotational speed of the first propulsion unit in each driveline is individually adjusted. According to the invention, the individual drivelines are controlled so that the combined, or average rotational output speed of the propeller shafts for all drivelines is sufficient for maintaining the requested vessel speed. As each of the internal combustion engines are controlled towards a suitable efficiency point, the load from the corresponding electric motor in each driveline is simultaneously adjusted towards a suitable efficiency point. By adjusting the internal combustion engine and the electric motor in each driveline to improve the efficiency of each driveline, the efficiency of the complete driveline installation is improved.

In operation, the rotational speed of the first propulsion unit in a particular driveline is adjusted towards an efficiency point determined from a map for that first propulsion unit. Simultaneously, the second propulsion unit in this driveline can be adjusted by reducing or increasing the load from the second propulsion unit onto the first propulsion unit in response to the adjustment of the rotational speed of the first propulsion unit towards the efficiency point. This means that the torque supplied to the driveline from the second propulsion unit can be positive or negative. Hence, if the adjustment of first propulsion unit towards a desired efficiency point requires a reduction of the load then the second propulsion unit can be operated to reduce the load from the second propulsion unit onto the first propulsion unit by providing an assisting, positive driving torque. Similarly, if the adjustment of first propulsion unit towards a desired efficiency point requires an increase of the load then the second propulsion unit can be operated to increase the load from the second propulsion unit onto the first propulsion unit by providing a braking, negative driving torque. Such an adjustment of the load from the second propulsion unit can be achieved by controlling it to charge an electrical storage unit, such as a battery or a supercapacitor.

When operating the second propulsion unit to reduce or increase the load from the second propulsion unit onto the first propulsion unit, the magnitude of the reduction or increase can be selected with respect to a desired efficiency point for the second propulsion unit. The decision to reduce or increase the load can primarily be made dependent on the determined efficiency point for the first propulsion unit and subsequently dependent on the determined efficiency point for the second propulsion unit. Hence, the adjustment of the load from the corresponding second propulsion unit can be weighted to give precedence to the efficiency of the first propulsion unit. However, the adjustment of the load from the corresponding second propulsion unit onto the first propulsion unit can be stopped before the first propulsion unit reaches a desired efficiency point, if the combined efficiency of the driveline reaches a maximum value. Consequently, neither the first nor the second propulsion unit would be operated at their respective desired efficiency points, but the combined efficiency of the driveline is improved. This control of the first and second propulsion units can be performed on at least one driveline in the marine hybrid system.

When adjusting the rotational speed of at least one first propulsion unit, this propulsion unit can be allowed to be operated at a different rotational speed than at least one other first propulsion unit in an installation comprising multiple drivelines. Consequently, at least one driveline can be controlled to be operated at a different rotational output speed than one or more additional drivelines. Alternatively, all drivelines can be operated at different rotational output speeds. A prerequisite is that the individual drivelines are controlled so that the combined, or average rotational output speed from all drivelines is sufficient for maintaining the requested vessel speed.

As indicted above, it is possible to control the drivelines so that they are operated at different rotational output speeds after having adjusted the rotational speed of each first propulsion unit towards a desired efficiency point. The thrust force of each individual driveline can then produce a combined thrust force directed at an angle to the central longitudinal axis of the vessel when travelling straight ahead. Alternatively, the direction of the combined thrust force can deviate from the desired steering direction requested by the operator. When this condition occurs, a correction of the steering angle of one or more drivelines or steerable propellers is required. For instance, if the vessel comprises two or more parallel hybrid drivelines, then the direction of the combined thrust force can be adjusted by a steering control unit controlling at least one of the drivelines in order to maintain the total thrust force in a desired direction.

Alternatively, it is possible to operate the drivelines to produce a combined thrust force that coincides with the currently requested steered direction. Dependent on the determined efficiency points for each individual driveline, it can be possible to achieve a combined thrust force having a neutral direction by selective adjustment of the drivelines making up the installation. In installations comprising three or more drivelines, it can be possible to operate drivelines in pairs, preferably drivelines located at equal distances from the central longitudinal axis of the vessel. According to a first example, the vessel comprises three parallel hybrid drivelines, wherein the drivelines located on either side of a central driveline are operated at a different rotational output speed than the central driveline. According to a second example, the vessel comprises four parallel hybrid drivelines, wherein the drivelines located on either side of a pair of central drivelines are operated at a different rotational output speed than the central drivelines. This principle of selecting pairs of symmetrically located drivelines operated at the same rotational output speed will balance the combined thrust force can be applied to installations comprising three or more drivelines.

According to a further example, if the vessel comprises two or more parallel hybrid drivelines, at least one driveline can be stopped if the rotational output speed of the remaining driveline or drivelines is sufficient for maintaining the requested vessel speed.

According to a second aspect of the invention, the object is achieved by a control unit to operate at least a first and a second parallel hybrid driveline arranged to drive a marine vessel, wherein the control unit is operated using the method according to the invention.

According to a third aspect of the invention, the object is achieved by a marine vessel with at least a first and a second parallel hybrid driveline arranged to drive a marine vessel, wherein the drivelines are operated using the method according to the invention.

According to a further aspect of the invention, the object is achieved by a computer program comprising program code means for performing all the method steps of the invention when said program is run on a computer.

According to a further aspect of the invention, the object is achieved by a computer program product comprising program code means stored on a computer readable medium for performing all the method steps of the invention when said program product is run on a computer.

The invention involves adjusting the internal combustion engine and the electric motor in each driveline to improve the efficiency of each driveline. An effect of this is that the efficiency of the complete driveline installation is improved. By using the fact that the installation has more than one driveline with separate battery banks the load can be balanced between the drivelines to achieve the best possible efficiency. Instead of only considering the efficiency map of each ICE, the efficiency maps of each ICE and the corresponding EM is considered when using the electric motor to place the load at the best place along the load axis of the ICE efficiency map. This is achieved by both balancing the load on the respective ICE using the electric motors and balancing the rotational speeds of the ICE:s between the drivelines. Balancing the rotational speed can involve increasing the rotational speed on one or more drivelines and decreasing the rotational speed on one or more other drivelines. In this way, the vessel speed requested by the operator can be maintained, while the freedom to run the engines and motors at a better speed/load combination.

Further advantages and advantageous features of the invention are disclosed in the following description and in the dependent claims.

BRIEF DESCRIPTION OF THE DRAWINGS

With reference to the appended drawings, below follows a more detailed description of embodiments of the invention cited as examples. In the drawings.

DETAILED DESCRIPTION OF EXAMPLE EMBODIMENTS OF THE INVENTION

Figure 1:
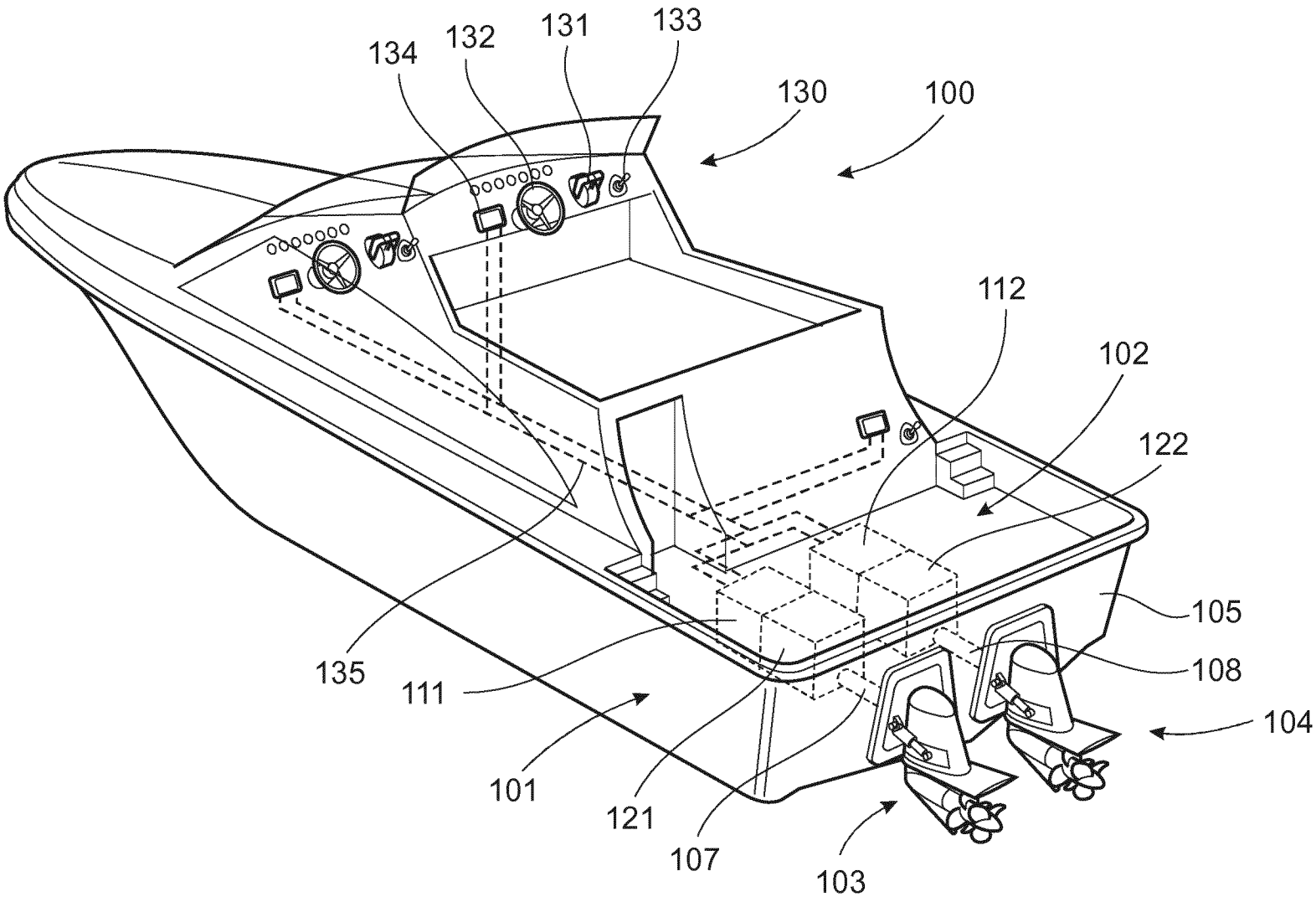
FIG. 1 shows a schematically illustrated vessel comprising a marine hybrid installation according to the invention.

FIG. 1 shows a schematically illustrated vessel 100 comprising a marine hybrid installation according to the invention. The hybrid installation in this figure comprises a first and a second parallel hybrid driveline 101, 102 arranged to drive the vessel 100 via a first and second drives 103, 104 mounted on the vessel transom 105. Each driveline 101, 102 comprises a first propulsion unit 111, 112 in the form of an internal combustion engine (ICE) operatively connected with a second propulsion unit 121, 122 in the form of an electric motor (EM) to drive a propeller shaft 107, 108 and produce a thrust force for propelling the vessel. Each second propulsion unit 121, 122 is connected to an individual source of electric power (not shown), such as an electric storage unit or battery.

A request indicative of a vessel speed can be received from an operating station 130 by means of a controller 131 operated by a user. In this example, multiple levers are used for controlling the driveline speeds. The controller can also be a joystick. The operating station 130 also comprises a steering wheel 132 for controlling the steered direction, a joystick 133 for operating the vessel during docking, and a display 134. The display 134 can be used for providing the operator with vessel and driveline related operating parameters, and/or for showing navigational information. The display can be a graphical user interface (GUI) and can be touch-sensitive. Control signals relating to propulsion and steering are transmitted from the operating station 130 to a corresponding propulsion control unit (see FIG. 3) and a steering control unit (not shown) via a CAN bus 135. As indicated in FIG. 1, more than one operating station can be provided.

Figure 2A:
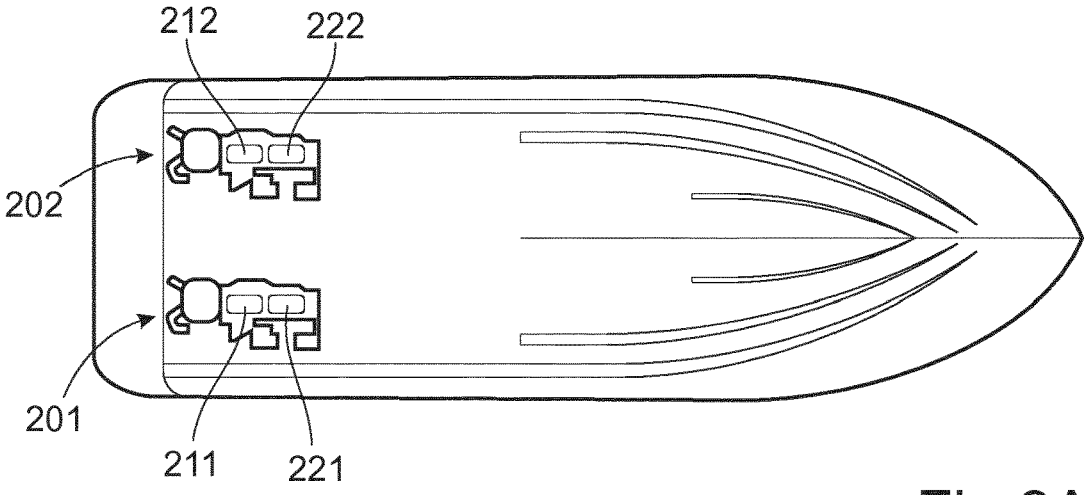
FIG. 2A-C show schematically illustrated vessels with alternative driveline installations.
Figure 2B:
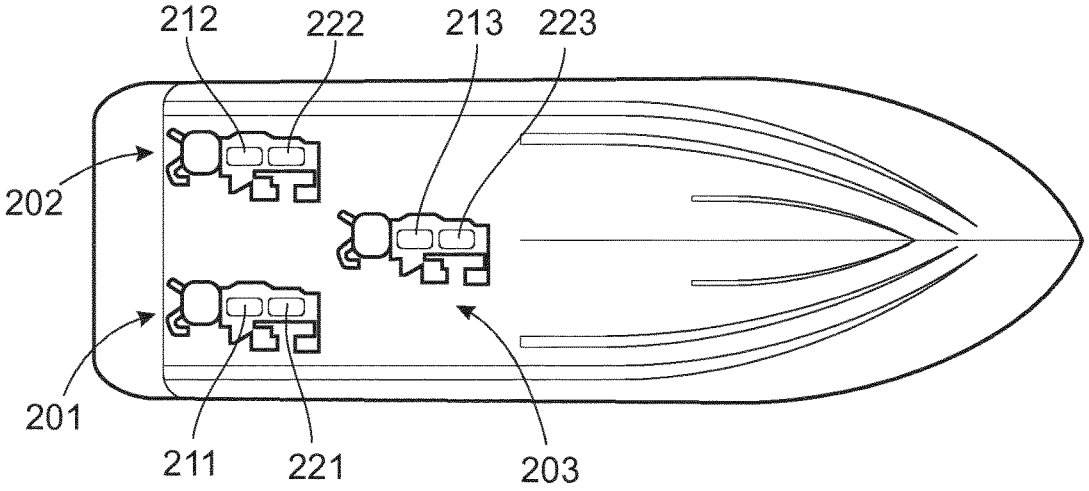
Figure 2C:
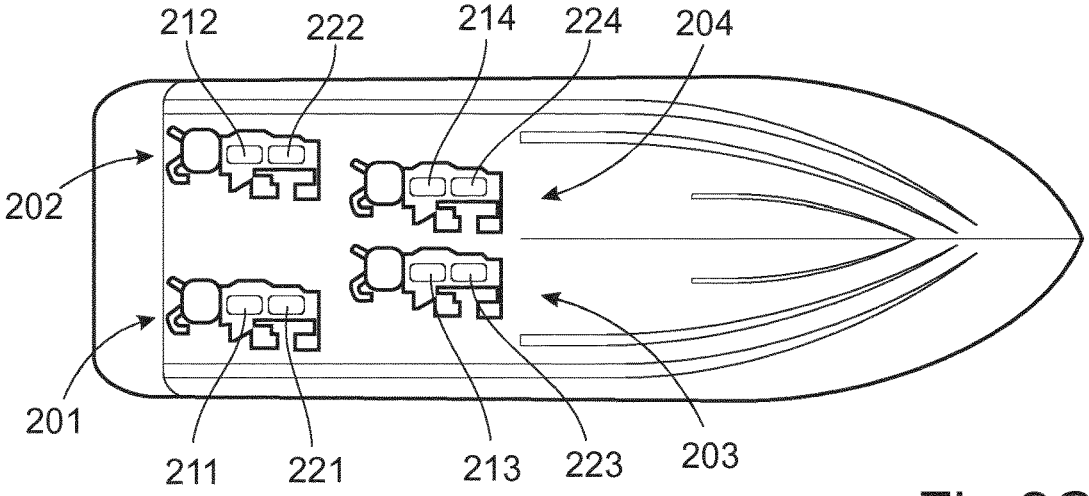

FIG. 2A-2C show schematically illustrated vessels with alternative driveline installations. FIG. 1 shows a vessel comprising two stern drives driven by parallel hybrid drivelines. However, the invention is applicable to other drives as indicated in FIGS. 2A-2C, showing multiple azimuthing drives.

FIG. 2A shows a vessel comprising two parallel hybrid drivelines 201, 202, wherein each driveline 201, 202 is provided with a first propulsion unit 211, 212 in the form of an internal combustion engine (ICE) operatively connected with a second propulsion unit 221, 222 in the form of an electric motor (EM).

FIG. 2B shows a vessel comprising three parallel hybrid drivelines 201, 202, 203, wherein each driveline 201, 202, 203 is provided with a first propulsion unit 211, 212, 213 in the form of an internal combustion engine (ICE) operatively connected with a second propulsion unit 221, 222, 223 in the form of an electric motor (EM).

FIG. 2C shows a vessel comprising four parallel hybrid drivelines 201, 202, 203, 204, wherein each driveline 201, 202, 203, 204 is provided with a first propulsion unit 211, 212, 213, 214 in the form of an internal combustion engine (ICE) operatively connected with a second propulsion unit 221, 222, 223, 224 in the form of an electric motor (EM).

The invention is not limited to the examples shown in FIGS. 2A-2C, but is applicable to any suitable driveline installation comprising multiple hybrid drivelines. The number of drivelines used is commonly decided by the size and speed requirements for each vessel. Consequently, relatively small vessels can use two hybrid drivelines as shown in FIG. 1, while relatively large vessels can use up to seven or eight drivelines.

Figure 3:
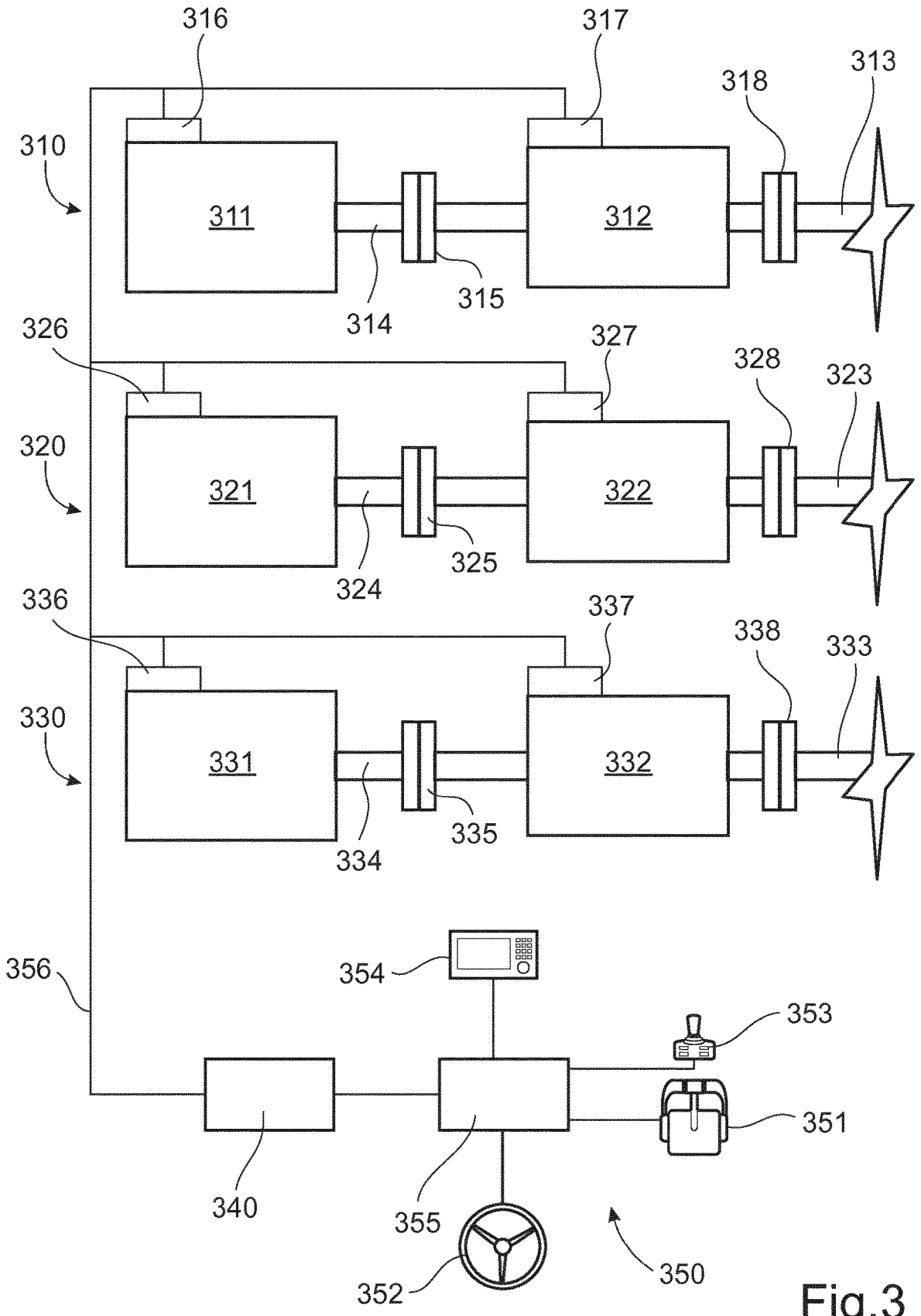
FIG. 3 shows a schematic illustration of a hybrid installation comprising three drivelines.

FIG. 3 shows a schematic illustration of a parallel hybrid driveline installation comprising three drivelines. The installation comprises a first, a second and a third parallel hybrid driveline 310, 320, 330 arranged to drive a marine vessel. Each driveline comprises a first propulsion unit 311, 321, 331 in the form of an internal combustion engine (ICE) operatively connected with a second propulsion unit 312, 322, 332 in the form of an electric motor (EM) to drive a propeller shaft 313, 323, 333 and produce a thrust force for propelling the vessel. Each first propulsion unit 311, 321, 331 is operatively connected to a respective second propulsion unit 312, 322, 332 via a driveshaft 314, 324, 334, which driveshaft can comprise an optional controllable clutch 315, 325, 335. A suitable reduction gearing or transmission (not shown) is provided adjacent the output shaft of each second propulsion unit. The reduction gearing is arranged to reduce the rotational speed of the propulsion units to a lower rotational output speed for the propeller shaft. Each second propulsion unit 312, 322, 332 is connected to an individual source of electric power (not shown), such as an electric storage unit or battery. Control units 316, 326, 336; 317, 327, 337 is arranged for individual control of each first and second propulsion unit 311, 321, 331; 312, 322, 332, respectively, in all the parallel hybrid drivelines. All parallel hybrid drivelines 310, 320, 330 are controlled by a central driveline control unit 340 communicating with and controlling each first and second propulsion unit in the respective drivelines. Each driveline 310, 320, 330 further comprises a controllable clutch 318, 328, 338 on their respective propeller shaft 313, 323, 333, allowing the central driveline control unit 340 to control the thrust force from each driveline 310, 320, 330.

An operating station 350 comprises a driveline speed controller 351 operated by a user. In this example, multiple levers are used for controlling the driveline speeds. The operating station 350 also comprises a steering wheel 352 for controlling the steered direction, a joystick 353 for operating the vessel during docking, and a display 354. The display 354 can be used for providing the operator with vessel and driveline related operating parameters, and/or for showing navigational information. The display can be a graphical user interface (GUI) 354 and can be touch-sensitive. Signals from the speed controller 351, the steering wheel 352, joystick 353 and the graphical user interface 354 are processed by a helm control unit 355, which in turn generates control signals to a steering controller (not shown) and the central driveline control unit 340. Control signals are transmitted from the operating station 350 to the central driveline control unit 340 and the steering control unit (not shown) via a CAN bus 356. The CAN bus 356 also connects the central driveline control unit 340 and the individual control units 316, 326, 336; 317, 327, 337 for the first and second propulsion units. Alternatively, transmission and exchange of data between the control units can be made using a Local Area Network (LAN) or a similar wired connection, or by using a suitable Wireless Local Area Network (WLAN) or other wireless technology such as WiFi or Bluetooth.

Figure 4:
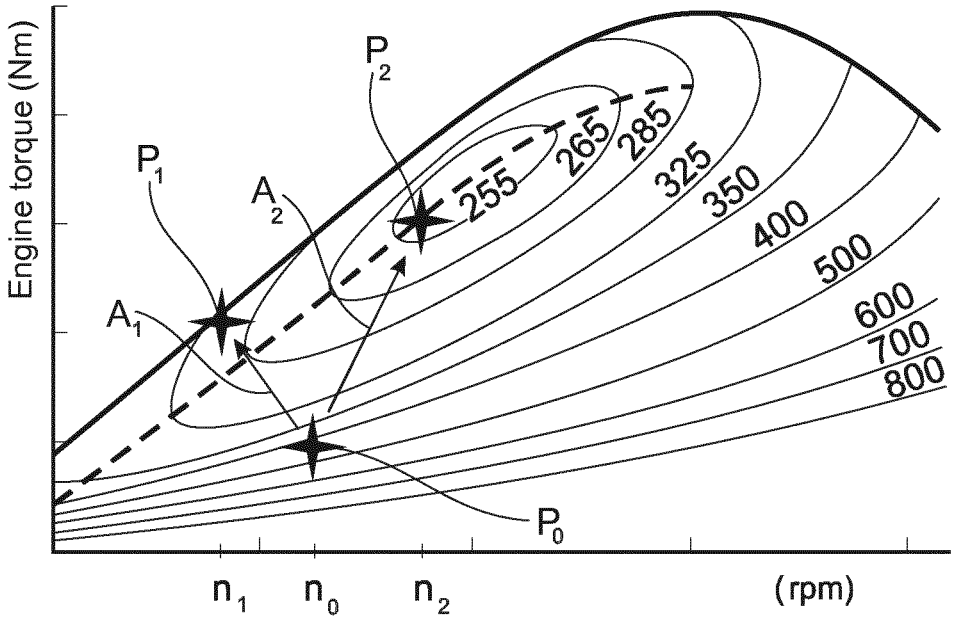
FIG. 4 shows an example of an efficiency map for an internal combustion engine.

FIG. 4 shows an example of an efficiency map for an internal combustion engine. The efficiency map is a diagram indicating engine torque (Nm) plotted on the y-axis over engine speed (rpm) plotted on the x-axis. The contour lines show the specific fuel consumption (g/kWh), indicating the areas of the speed/load regime where the engine is more or less efficient. In the diagram, it is desirable to operate an engine within contour lines having lower values for specific fuel consumption. An upper line delimiting the plotted contour lines indicates the maximum engine torque that the engine can achieve for different engine speeds.

Figure 5:
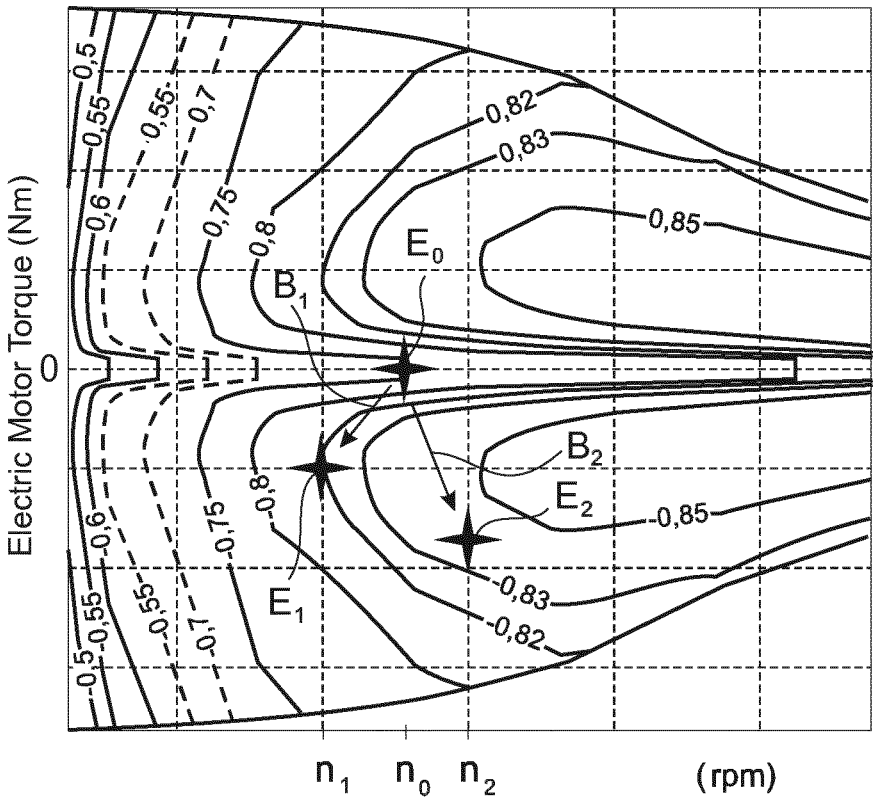
FIG. 5 shows an example of an efficiency map for an electric motor.

FIG. 5 shows an example of an efficiency map for an electric motor. The efficiency map is a diagram indicating motor torque (Nm) plotted on the y-axis over motor speed (rpm) plotted on the x-axis. The contour lines show the motor efficiency (dimensionless), indicating the areas of the speed/load regime where the motor is more or less efficient in converting electrical power to mechanical power. In the diagram, it is desirable to operate an electric motor within a contour line having higher values for efficiency.

The following example is described with reference to a marine vessel with an installation comprising a first and a second hybrid driveline. Each hybrid driveline comprises a first propulsion unit in the form of an internal combustion engine, and a second propulsion unit in the form of an electric motor. Efficiency maps for the engine and the motor are stored in a central control unit or in individual control unit for the respective propulsion unit.

In operation, the internal combustion engines in both drivelines are initially operated at a requested engine speed no, indicated at the point $P_0$ in FIG. 4. In order to improve the efficiency of the installation, the rotational speed of the first propulsion unit in the first hybrid driveline is adjusted towards a first efficiency point $P_1$, which point is determined from a stored engine efficiency map for the first propulsion unit. The direction of the adjustment is indicated by an arrow $A_1$. This adjustment involves a reduction of the engine speed of the first propulsion unit from the requested engine speed $n_0$ to a lower, first engine speed $n_1$. To achieve this, the second propulsion unit in the first hybrid driveline is adjusted by increasing the load from the second propulsion unit onto the first propulsion unit in response to the required lowering of the rotational speed of the first propulsion unit. This is shown in FIG. 5, where the second propulsion unit is adjusted from an initial motor speed $n_0$ at an initial operating point $E_0$, where no torque is generated, to a first motor speed $n_1$ at a first operating point $E_1$, where a negative, braking torque is generated. The initial motor speed $n_0$ is equal to the initial engine speed $n_0$ of the first propulsion unit. The direction of the adjustment is indicated by an arrow $B_1$. This negative torque increases the load from the second propulsion unit onto the first propulsion unit, which second propulsion unit is now being operated at a motor speed $n_1$ equal to the rotational speed of the first propulsion unit.

Simultaneously, the rotational speed of the first propulsion unit in the second hybrid driveline is adjusted towards a second efficiency point $P_2$, which point is determined from a stored efficiency map for this first propulsion unit. The direction of the adjustment is indicated by an arrow $A_2$. The adjustment involves an increase of the engine speed of the first propulsion unit from the requested engine speed $n_0$ to a higher, second engine speed $n_2$. At the same time, the second propulsion unit in the second hybrid driveline is adjusted by increasing the load from the second propulsion unit onto the first propulsion unit in response to the required increase of the rotational speed of the first propulsion unit. This is shown in FIG. 5, where the second propulsion unit is adjusted from an initial motor speed $n_0$ at the initial operating point $E_0$, where no torque is generated, to a second motor speed $n_2$ at a second operating point $E_2$, where a negative, braking torque is generated. The direction of the adjustment is indicated by an arrow $B_2$. This negative torque increases the load from the second propulsion unit on the first propulsion unit which is now being operated at a motor speed $n_2$ corresponding to the rotational speed of the first propulsion unit. The operation of the second propulsion units to provide a braking, negative driving torque can be achieved by controlling the second propulsion units to charge their respective electrical storage units, such as a battery or a supercapacitor.

When adjusting the rotational speed of the first propulsion units of the respective drivelines, the propulsion units are allowed to be operated at a different rotational speeds $n_1$, $n_2$. The rotational speed $n_1$, $n_2$ of the respective first propulsion unit is controlled so that the combined, or average rotational speed from all first propulsion unit corresponds to the initially requested rotational speed $n_0$ for all first propulsion units. This will provide a combined rotational output speed from all drivelines required for maintaining the requested vessel speed.

Figure 6A:
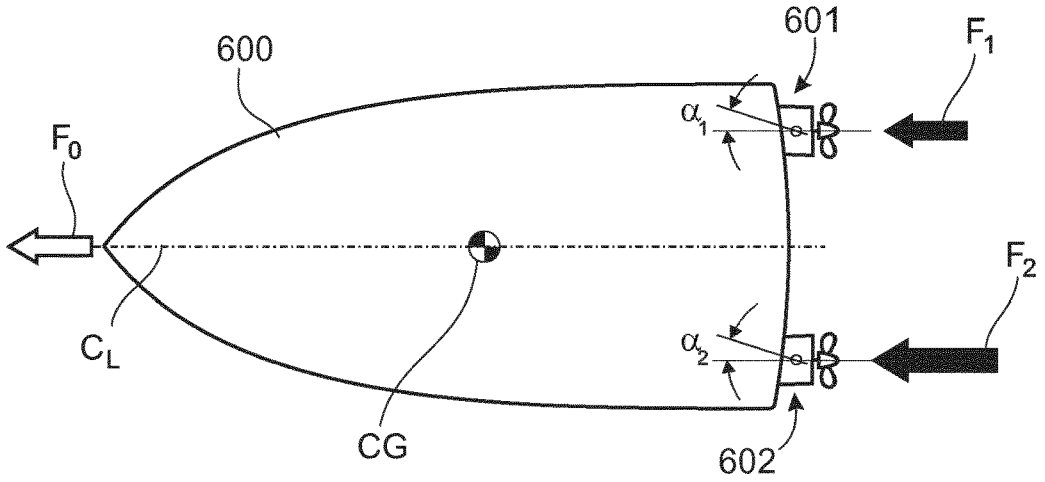
FIG. 6A-C show examples of thrust force distribution for alternative driveline installations.
Figure 6B:
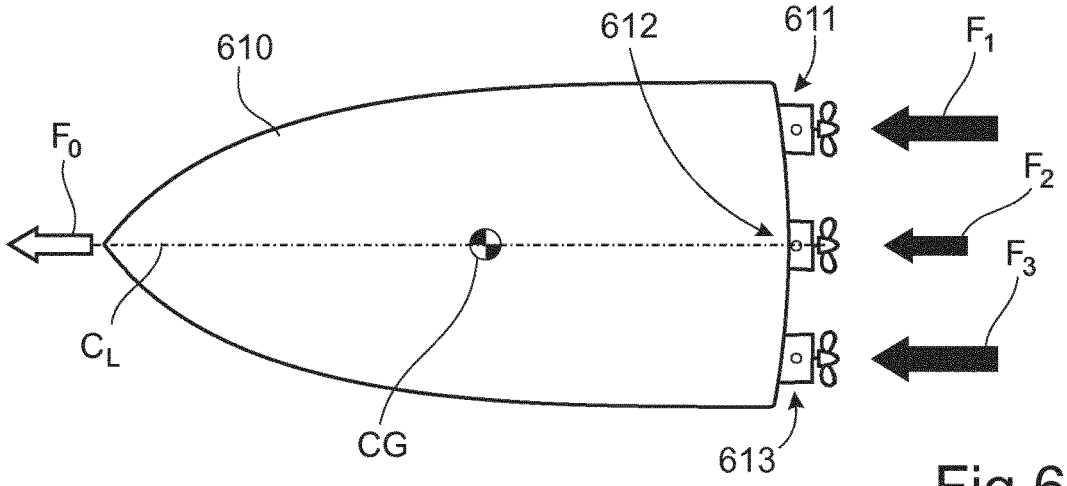
Figure 6C:
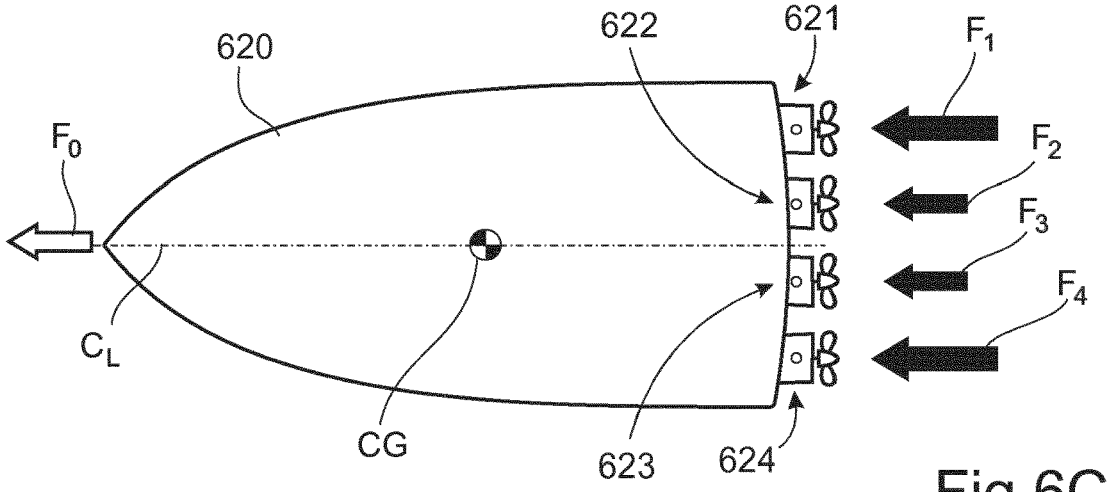

FIGS. 6A-6C show examples of thrust force distribution for a number of alternative driveline installations. According to the invention, it is possible to control the drivelines so that they are operated at different rotational output speeds after adjustment of the rotational speed of each first propulsion unit towards a desired efficiency point.

FIG. 6A shows an example of thrust force distribution for installations comprising two drivelines. FIG. 6A shows a vessel 600 comprising two parallel hybrid drivelines 601, 602. According to this example, a first propulsion unit in a first driveline 601 has been adjusted towards a desired efficiency point, which adjustment has required a reduction of the rotational speed for the first propulsion unit and an increase of the load from the second propulsion unit (see FIG. 4, ref. "$P_1$"). This increase of the load from the second propulsion unit provides a braking, negative driving torque applied to the first propulsion unit of the first driveline 601. The speed reduction has resulted in a reduced first thrust force $F_1$, indicated by an arrow in FIG. 6A. Simultaneously, a first propulsion unit in a second driveline 602 has also been adjusted towards the desired efficiency point, which adjustment has required an increase of the rotational speed for the first propulsion unit and an increase of the load from the second propulsion unit (see FIG. 4, ref. "$P_2$"). This increase of the load from the second propulsion unit provides a braking, negative driving torque applied to the first propulsion unit of the second driveline 602. The speed increase has resulted in an increased second thrust force $F_2$, indicated by an arrow in FIG. 6A. From FIG. 6A it can be seen that the magnitude of the thrust force $F_2$ from the second driveline 602 is greater than that of the thrust force $F_1$ from the first driveline 601. This will cause a turning moment about the center of gravity CG of the vessel 600, which must be compensated for in order to prevent a deviation from the steered direction requested by the operator. The turning moment can be eliminated by a correction of the steering angle $\alpha_1$ and/or $\alpha_2$ of the first driveline 601 and the second driveline 602, respectively. Such a correction can be performed by a steering control unit (not shown) in the same way as such a unit performs a correction for sideways drift caused by wind or currents. Steering control units of this type will not be described in further detail here. In this way the direction of the combined thrust force comprising the first thrust force $F_1$ and the second thrust force can be adjusted by the steering control unit in order to maintain a total thrust force $F_0$ in a desired direction. In addition, as the thrust forces are proportional to the rotational output speed of the respective first and second driveline, the individual drivelines are controlled so that the average rotational output speed from all drivelines is sufficient for maintaining the requested vessel speed. If the steering angle of one or more drivelines is corrected as indicated above, then an increase of rotational output speed can be required for one or both drivelines for maintaining the requested vessel speed.

Alternatively, if the vessel is provided with a steerable rudder and fixed drive units, then the rudder can be used to compensate for the deviation from the steered direction.

FIG. 6B shows an example of thrust force distribution for installations comprising three drivelines. FIG. 6B shows a vessel 610 comprising three parallel hybrid drivelines 611, 612, 613. According to this example, a first propulsion unit in a first driveline 611 and a third driveline 613 have been adjusted towards a desired efficiency point, which adjustment has required an increase of the rotational speed for the first propulsion unit and an increase of the load from the second propulsion unit (see FIG. 4, ref. "$P_2$"). This increase of the load from the second propulsion unit provides a braking, negative driving torque applied to the first propulsion unit of the first driveline 611 and the third driveline 613. The speed increase has resulted in increased first and third thrust forces $F_1$, $F_3$, indicated by arrows in FIG. 6B, which forces are equal in magnitude.

Simultaneously, a first propulsion unit in a second driveline 612 has also been adjusted towards the desired efficiency point, which adjustment has required a reduction of the rotational speed for the first propulsion unit and an increase of the load from the second propulsion unit (see FIG. 4, ref. "$P_1$"). This increase of the load from the second propulsion unit provides a braking, negative driving torque applied to the first propulsion unit of the second driveline 612. The speed reduction has resulted in a reduced second thrust force $F_2$, indicated by an arrow in FIG. 6B. The rotational output speeds of the individual drivelines 611, 612, 613 are controlled so that the average rotational output speed from all drivelines is sufficient for maintaining the requested vessel speed.

From FIG. 6B it can be seen that the magnitude of the thrust forces $F_1$, $F_3$ from the first and third drivelines 611, 612 are greater than that of the thrust force $F_2$ from the second driveline 612. As the installation in FIG. 6B comprises three drivelines, it is possible to operate the first and third drivelines as a pair. According to this example, the first and third drivelines 611, 613 are located with equal spacing from the centerline $C_L$ of the vessel on either side of the second driveline 612 located on the centerline $C_L$. The first and third drivelines 611, 613 are operated at the same rotational output speed, which is higher than the rotational output speed of the central second driveline 612. In this way it is possible to operate the drivelines to produce a combined thrust force $F_0$ that is equal to the sum of the individual thrust forces $F_1$, $F_2$, $F_3$, and which coincides with the currently requested steered direction. Dependent on the determined efficiency points for each individual driveline, it is possible to achieve a combined thrust force having a neutral direction by selective adjustment of the drivelines making up the installation.

FIG. 6C shows an example of thrust force distribution for installations comprising four drivelines. FIG. 6C shows a vessel 620 comprising four parallel hybrid drivelines 621, 622, 623, 624. According to this example, a first propulsion unit in a first driveline 621 and a fourth driveline 624 have been adjusted towards a desired efficiency point, which adjustment has required an increase of the rotational speed for the first propulsion unit and an increase of the load from the respective second propulsion unit (see FIG. 4, ref. "$P_2$"). This increase of the load from the second propulsion unit provides a braking, negative driving torque applied to the first propulsion unit of the first driveline 621 and the fourth driveline 624. The speed increase has resulted in increased first and fourth thrust forces $F_1$, $F_4$, indicated by arrows in FIG. 6C, which forces are equal in magnitude.

Simultaneously, a first propulsion unit in a second driveline 612 and a third driveline 613 have also been adjusted towards the desired efficiency point, which adjustment has required a reduction of the rotational speed for the first propulsion unit and an increase of the load from the respective second propulsion unit (see FIG. 4, ref. "$P_1$"). This increase of the load from the second propulsion unit provides a braking, negative driving torque applied to the first propulsion unit of the second driveline 612. The speed reduction has resulted in reduced second and third thrust forces $F_2$, $F_3$, indicated by arrows in FIG. 6C. The rotational output speeds of the individual drivelines 621, 622, 623, 624 are controlled so that the average rotational output speed from all drivelines is sufficient for maintaining the requested vessel speed.

From FIG. 6C it can be seen that the magnitude of the outermost thrust forces $F_1$, $F_4$ from the first and fourth drivelines 621, 624 are greater than that of the innermost thrust forces $F_2$, $F_3$ from the second and third drivelines 622, 623. As the installation in FIG. 6C comprises four drivelines, it is possible to operate the outermost first and fourth drivelines, as well as the innermost second and third drivelines 622, 623 as pairs. According to this example, the first and fourth drivelines 621, 624 are located with equal spacing from the centerline $C_L$ of the vessel on either side of the second and third driveline 622, 623, which in turn are located with equal spacing from the centerline $C_L$ inside the first and fourth drivelines 621, 624. The first and fourth drivelines 621, 624 are operated at the same rotational output speed, which is higher than the rotational output speed of the innermost second drivelines 622, 623. In this way it is possible to operate the drivelines to produce a combined thrust force $F_0$ that is equal to the sum of the individual thrust forces $F_1$, $F_2$, $F_3$, $F_4$, and which coincides with the currently requested steered direction. Dependent on the determined efficiency points for each individual driveline, it is possible to achieve a combined thrust force having a neutral direction by selective adjustment of the drivelines making up the installation.

According to the invention, a vessel can comprise three or more parallel hybrid drivelines, wherein the drivelines located equidistantly on either side of the centerline of the vessel can be operated in pairs. This principle of selecting pairs of symmetrically located drivelines operated at the same rotational output speed will balance the combined thrust force can be applied to installations comprising any number of drivelines. However, the invention is not limited to this principle. Within the scope of the invention it is also possible to operate all drivelines in the installation at different rotational output speeds, as long as the average rotational output speed from all drivelines is sufficient for maintaining the requested vessel speed.

According to a further example, if the vessel comprises two or more parallel hybrid drivelines, at least one driveline can be stopped if the rotational output speed of the remaining driveline or drivelines is sufficient for maintaining the requested vessel speed.

Figure 7:
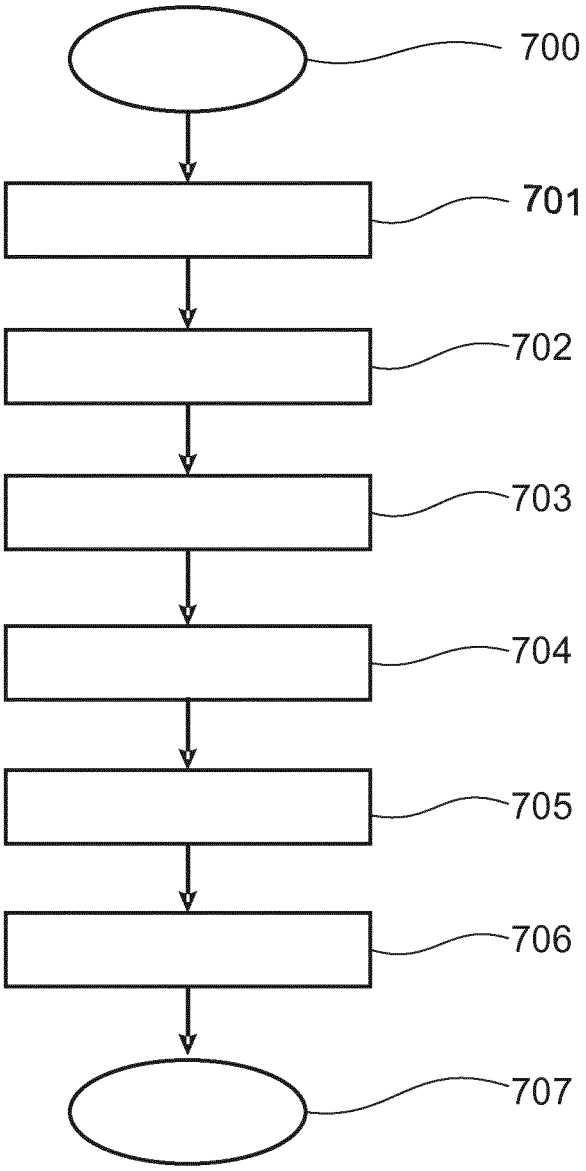
FIG. 7 shows a schematic diagram illustrating the operation of a driveline.

FIG. 7 shows a schematic diagram illustrating the operation of a driveline. In operation, the method is triggered in an initial step 700 when the vessel is being operated. In a first step 701 a control unit receives a request indicative of a vessel speed. In a second step 702, the control unit determines a rotational speed for each first propulsion unit for achieving the requested vessel speed, based on the received request. In a third step 703, efficiency points are determined for each of the first propulsion units and the second propulsion units from stored efficiency maps for each propulsion unit, based on the determined rotational speeds for the first propulsion unit in the respective drivelines. In a fourth step 704, the rotational speed of the first propulsion unit in each powertrain is individually adjusted to improve the efficiency of this first propulsion unit while maintaining the requested vessel speed. Simultaneously, a fifth step 705 involves adjusting the load on the corresponding second propulsion unit in each powertrain to improve the efficiency of each powertrain and the complete powertrain installation. In a sixth step 706, the individual powertrains are controlled so that the combined, average rotational output speed from all drivelines is sufficient for maintaining the requested vessel speed. In a final step 707, the process returns to the first step if a request for a new rotational speed for the first propulsion units is received. The method is ended if an engine off signal is received.

Figure 8:
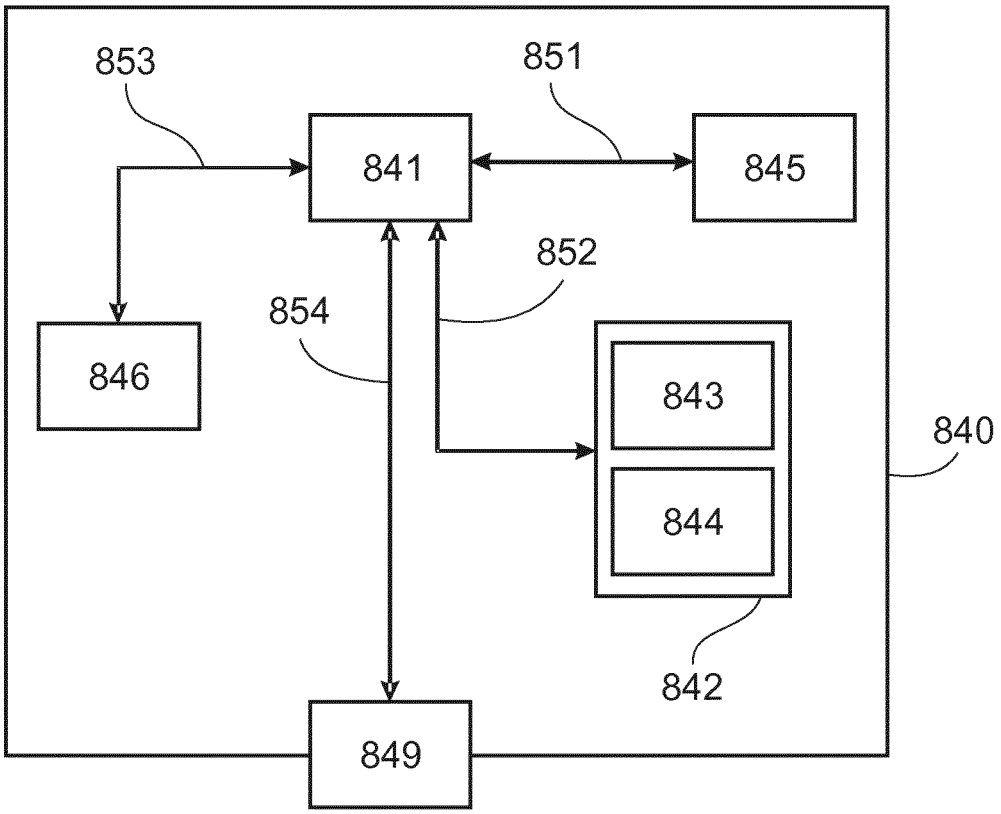
FIG. 8 shows the invention applied on a computer arrangement.

The present disclosure also relates to a computer program, computer program product and a storage medium for a computer all to be used with a computer for executing said method. FIG. 8 shows an apparatus 840 according to one embodiment of the invention, comprising a nonvolatile memory 842, a processor 841 and a read and write memory 846. The memory 842 has a first memory part 843, in which a computer program for controlling the apparatus 840 is stored. The computer program in the memory part 843 for controlling the apparatus 840 can be an operating system. The apparatus 840 can be enclosed in, for example, a control unit, such as the control unit 340 shown in FIG. 3. The data-processing unit 841 can comprise, for example, a microcomputer.

The memory 842 also has a second memory part 844, in which a program for controlling the target gear selection function according to the invention is stored. In an alternative embodiment, the program for controlling the transmission is stored in a separate nonvolatile storage medium 845 for data, such as, for example, a CD or an exchangeable semiconductor memory. The program can be stored in an executable form or in a compressed state. When it is stated below that the data-processing unit 841 runs a specific function, it should be clear that the data-processing unit 841 is running a specific part of the program stored in the memory 844 or a specific part of the program stored in the non-volatile storage medium 845.

The data-processing unit 841 is tailored for communication with the storage memory 845 through a data bus 851. The data-processing unit 841 is also tailored for communication with the memory 842 through a data bus 852. In addition, the data-processing unit 841 is tailored for communication with the memory 846 through a data bus 853. unit 841 is also tailored for communication with a data port 859 by the use of a The data-processing unit 841 is also tailored for communication with a data port 849 by the use of a data bus 854. The method according to the present invention can be executed by the data-processing unit 841, by the data-processing unit 841 running the program stored in the memory 844 or the program stored in the nonvolatile storage medium 845.

It is to be understood that the present invention is not limited to the embodiments described above and illustrated in the drawings; rather, the skilled person will recognize that many changes and modifications may be made within the scope of the appended claims.

The invention claimed is:

1. A method to control a marine vessel hybrid installation, the installation comprises:

at least a first and a second parallel hybrid driveline arranged to drive the marine vessel, where each of the at least first and second parallel hybrid drivelines comprises a first propulsion unit in the form of an internal combustion engine operatively connected with a second propulsion unit in the form of an electric motor to drive a propeller shaft and produce a thrust force, and at least one control unit, where the at least one control unit is arranged to control each of the each first and second propulsion units in the at least first and second parallel hybrid drivelines; characterized by performing the steps of:

receiving a request indicative of a vessel speed;

determining a rotational speed for each of the first propulsion units of the at least first and second parallel hybrid drivelines for achieving the requested vessel speed, based on the received request;

determining efficiency points for each of the first and the second propulsion units of the at least first and second parallel hybrid drivelines from their stored efficiency maps, based on the determined rotational speeds for each of the first propulsion units of the at least first and second parallel hybrid drivelines;

individually adjusting the rotational speed of the first propulsion unit in each of the at least first and second parallel hybrid drivelines towards the determined efficiency point to improve the efficiency of the first propulsion unit of the at least first and second parallel hybrid drivelines while maintaining the requested vessel speed, and simultaneously adjusting a load from the corresponding second propulsion unit in each of the at least first and second parallel hybrid drivelines by reducing or increasing the load from the second propulsion unit in response to the adjustment of the rotational speed of the corresponding first propulsion unit to improve the efficiency of each of the at least first and second parallel hybrid drivelines and the installation;

wherein the first and second propulsion units of the at least first and second parallel hybrid drivelines are controlled by exchanging control data between a central control unit and the at least first and second parallel hybrid drivelines or between individual control units for each of the at least first and second parallel hybrid drivelines so that a combined rotational speed from the first propulsion unit of the at least first and second parallel hybrid drivelines is sufficient for maintaining the requested vessel speed, wherein the step of adjusting the rotational speed of the first propulsion unit of the at least first and second parallel hybrid drivelines further comprises allowing the first propulsion unit to be operated at a different rotational speed in the corresponding first or second parallel hybrid driveline than the rotational speed of the first propulsion unit in the other parallel hybrid drivelines.

2. The method according to claim 1, characterized by controlling one of the at least first and second parallel hybrid drivelines to be operated at a different rotational output speed than rotational output speed of the other parallel hybrid drivelines.

3. The method according to claim 1, characterized by weighting the adjustment of the load from the corresponding second propulsion unit to give precedence to the efficiency of the first propulsion unit.

4. The method according to claim 1, characterized by adjusting the load from the second propulsion unit by controlling the second propulsion unit to charge an electrical storage unit.

5. The method according to claim 1, characterized in that the marine vessel further comprises two or more parallel hybrid drivelines, wherein a direction of the thrust force is adjusted for at least one of the parallel hybrid drivelines in order to maintain a total thrust force in a desired direction.

6. The method according to claim 1, characterized in that the marine vessel further comprises two or more parallel hybrid drivelines, wherein at least one of the parallel hybrid drivelines is stopped if a rotational output speed of the remaining drivelines is sufficient for maintaining the requested vessel speed.

7. The method according to claim 1, characterized in that the marine vessel further comprises at least three parallel hybrid drivelines, wherein the at least three parallel hybrid drivelines located at equal distances from the central longitudinal axis of the vessel are operated at the same rotational output speed.

8. The method according to claim 1, characterized in that the central control unit is arranged to control the first and second propulsion units in all the at least first and second parallel hybrid drivelines.

9. The method according to claim 1, characterized in that the individual control units are arranged to control the first and second propulsion units in each of the at least first and second parallel hybrid drivelines.

10. A control unit to operate at least a first and a second parallel hybrid driveline arranged to drive a marine vessel installation, the installation comprises: at least a first and a second parallel hybrid driveline arranged to drive the marine vessel, where each of the at least first and second parallel hybrid drivelines comprises a first propulsion unit in the form of an internal combustion engine operatively connected with a second propulsion unit in the form of an electric motor to drive a propeller shaft and produce a thrust force, and the control unit, where the control unit performs the steps of:

receiving a request indicative of a vessel speed;

determining a rotational speed for each of the first propulsion units of the at least first and second parallel hybrid drivelines for achieving the requested vessel speed, based on the received request;

determining efficiency points for each of the first and the second propulsion units of the at least first and second parallel hybrid drivelines from their stored efficiency maps, based on the determined rotational speeds for each of the first propulsion unites of the at least first and second parallel hybrid drivelines;

individually adjusting the rotational speed of the first propulsion unit in each of the at least first and second parallel hybrid drivelines towards the determined efficiency point to improve the efficiency of the first propulsion unit of the at least first and second parallel hybrid drivelines while maintaining the requested vessel speed, and simultaneously adjusting a load from the corresponding second propulsion unit in each of the at least first and second parallel hybrid drivelines by reducing or increasing the load from the second propulsion unit in response to the adjustment of the rotational speed of the corresponding first propulsion unit to improve the efficiency of each of the at least first and second parallel hybrid drivelines and the installation;

wherein the first and the second propulsion units of the at least first and second parallel hybrid drivelines are controlled by exchanging control data between a central control unit and the at least first and second parallel hybrid drivelines or between individual control units for each of the at least first and second parallel hybrid drivelines so that a combined rotational speed from the first propulsion unit of the at least first and second parallel hybrid drivelines is sufficient for maintaining the requested vessel speed, wherein the steps of adjusting the rotational speed of the first propulsion unit of the at least first and second parallel hybrid drivelines further comprises allowing the first propulsion unit to be operated at a different rotational speed in the corresponding first or second parallel hybrid driveline than the rotational speed of the first propulsion unit in the other parallel hybrid drivelines.

11. A marine vessel with at least a first and a second parallel hybrid driveline comprising of a first propulsion unit in the form of an internal combustion engine operatively connected with a second propulsion unit in the form of an electric motor to drive a propeller shaft and produce a thrust force, and where-at least one control unit, where the at least one control unit is arranged to drive the marine vessel by operating the at least first and second parallel hybrid drivelines by:

receiving a request indicative of a vessel speed;

determining a rotational speed for each of the first propulsion units of the at least first and second parallel hybrid drivelines for achieving the requested vessel speed, based on the received request;

determining efficiency points for each of the first and the second propulsion units of the at least first and second parallel hybrid drivelines from their stored efficiency maps, based on the determined rotational speeds for each of the first propulsion units of the at least first and second parallel hybrid drivelines;

individually adjusting the rotational speed of the first propulsion unit in each of the at least first and second parallel hybrid drivelines towards the determined efficiency point to improve the efficiency of the first propulsion unit of the at least first and second parallel hybrid drivelines while maintaining the requested vessel speed, and simultaneously adjusting a load from the corresponding second propulsion unit in each of the at least first and second parallel hybrid drivelines by reducing or increasing the load from the second propulsion unit in response to the adjustment of the rotational speed of the corresponding first propulsion unit to improve the efficiency of each of the at least first and second parallel hybrid drivelines and the installation;

wherein the first and the second propulsion units of the at least first and second parallel hybrid drivelines are controlled by exchanging control data between a central control unit and the at least first and second parallel hybrid drivelines or between individual control units for each of the at least first and second parallel hybrid drivelines so that a combined rotational speed from the first propulsion unit of the at least first and second parallel hybrid drivelines is sufficient for maintaining the requested vessel speed, wherein the step of adjusting the rotational speed of the first propulsion unit of the at least first and second parallel hybrid drivelines further comprises allowing the first propulsion unit to be operated at a different rotational speed in the corresponding first or second parallel hybrid driveline than the rotational speed of the first propulsion unit in the other parallel hybrid drivelines.

12. A non-transitory computer program product comprising program code means stored on a computer readable medium, when said program code is run on a computer, the computer controls a marine vessel hybrid installation, the installation comprises: at least a first and a second parallel hybrid driveline arranged to drive the marine vessel, where each of the at least first and second parallel hybrid drivelines comprises a first propulsion unit in the form of an internal combustion engine operatively connected with a second propulsion unit in the form of an electric motor to drive a propeller shaft and produce a thrust force, and at least one control unit, where the at least one control unit is arranged to control each of the first and second propulsion units in the at least first and second parallel hybrid drivelines; characterized by performing the steps of:

receiving a request indicative of a vessel speed;

determining a rotational speed for each of the first propulsion units of the at least first and second parallel hybrid drivelines for achieving the requested vessel speed, based on the received request;

determining efficiency points for each of the first and the second propulsion units of the at least first and second parallel hybrid drivelines from their stored efficiency maps, based on the determined rotational speeds for each of the first propulsion units of the at least first and second parallel hybrid drivelines;

individually adjusting the rotational speed of the first propulsion unit in each of the at least first and second parallel hybrid drivelines towards the determined efficiency point to improve the efficiency of the first propulsion unit of the at least first and second parallel hybrid drivelines while maintaining the requested vessel speed, and simultaneously adjusting a load from the corresponding second propulsion unit in each of the at least first and second parallel hybrid drivelines by reducing or increasing the load from the second propulsion unit in response to the adjustment of the rotational speed of the corresponding first propulsion unit to improve the efficiency of each of the at least first and second parallel hybrid drivelines and the installation;

wherein the first and the second propulsion units of the at least first and second parallel hybrid drivelines are controlled by exchanging control data between a central control unit and the at least first and second parallel hybrid drivelines or between individual control units for each of the at least first and second parallel hybrid drivelines so that a combined rotational speed from the first propulsion unit of the at least first and second parallel hybrid drivelines is sufficient for maintaining the requested vessel speed, wherein the step of adjusting the rotational speed of the first propulsion unit of the at least first and second parallel hybrid drivelines further comprises allowing the first propulsion unit to be operated at a different rotational speed in the corresponding first or second parallel hybrid driveline than the rotational speed of the first propulsion unit in the other parallel hybrid drivelines.

* * * * *